US005526671A

United States Patent [19]

Polen

[11] Patent Number: 5,526,671

[45] Date of Patent: Jun. 18, 1996

[54] METHOD AND APPARATUS FOR LEVELING A DIE ON A DIE-FORMING MACHINE

[76] Inventor: Larry A. Polen, 625 Raintree Dr., Matthews, N.C. 28105

[21] Appl. No.: 370,488

[22] Filed: Jan. 9, 1995

[51] Int. Cl.[6] ..... B21D 11/02

[52] U.S. Cl. ..... 72/455; 72/297; 72/20.1

[58] Field of Search ..... 72/298, 303, 310, 72/21, 296, 297, 446, 447, 448, 455

[56] References Cited

U.S. PATENT DOCUMENTS

| | | | |
|---|---|---|---|
| 2,759,513 | 8/1956 | Green | 72/297 |
| 3,948,071 | 4/1976 | Lieberman et al. | 72/21 |
| 4,070,896 | 1/1978 | Heitner | 72/389 |
| 4,170,124 | 10/1979 | MacGregor | 72/446 |
| 4,656,861 | 4/1987 | Koyama et al. | 72/323 |
| 4,797,831 | 1/1989 | Dressing et al. | 72/21 |
| 4,827,753 | 5/1989 | Moroney | 72/297 |
| 4,866,975 | 9/1989 | Hopkins | 72/448 |
| 5,199,290 | 4/1993 | Kashiwagi et al. | 72/21 |
| 5,205,149 | 4/1993 | Hayashi | 72/446 |
| 5,249,452 | 10/1993 | Baldwin et al. | 72/389 |

*Primary Examiner*—David Jones
*Attorney, Agent, or Firm*—W. Thad Adams, III

[57] ABSTRACT

A leveling apparatus for leveling a die mounted on die posts on a die base. The die base has first and second die posts on which is mounted a die for adjustable vertical movement. A first motor is operatively connected to the first die post for moving the first die post in a vertical direction. A first vertical position sensor cooperates with the first motor for sensing the vertical position of the first die post. A first servo-feedback device interconnects the first motor and the first vertical position sensor for transmitting a vertical position signal from the first vertical position sensor to the first servo-feedback device. A second motor is operatively connected to the second die post for moving the second die post in a vertical direction. A second vertical position sensor cooperates with the second motor for sensing the vertical position of the second die post. A second servo-feedback device interconnects the second motor and the second vertical position sensor for transmitting a vertical position signal from the second vertical position sensor to the second servo-feedback device.

8 Claims, 8 Drawing Sheets

METHOD AND APPARATUS FOR LEVELING A DIE ON A DIE-FORMING MACHINE

TECHNICAL FIELD AND BACKGROUND OF THE INVENTION

This invention relates to a method and apparatus for leveling a die on a die-forming machine, such as a stretch-wrapping machine. More specifically, the invention relates to a method and apparatus for automatically leveling a die supported on two die posts. Such machines are used to place bends in a metal member such as an extrusion, I-beam or the like. The machine functions by bending the member around a die to form it into the proper shape.

In one type of machine, the die is moved against the member while the ends of the member are clamped ;in jaws. In another type of machine, the die is held stationary and the jaws are mounted on arms which stretch the ends of the member around the die. An another type of machine, both the die and the jaws move. In either case, it is important to carefully adjust the die so that the member is urged against the die in exactly the correct orientation.

In many prior art die-forming machines, the die is mounted on one or more die posts. The die posts are adjustable with a pair of jack screws. A level is placed on top of the die and the jack screws are adjusted until the level indicates that the die is positioned correctly. This trial-and-error process is time-consuming because not only must the die be level, but it must be at exactly the correct vertical position, as well, in order to mate properly with the member being formed.

In this application the term "level" is used in the sense of correct orientation relative to the horizontal dimension, as distinguished from the vertical dimension. The method and apparatus according to the invention achieve both correct horizontal and vertical orientation simultaneously and automatically. Most often, the correct horizontal dimension will be one which is precisely 90 degrees from the vertical. However, other predetermined orientations can also be obtained according to the principles of this invention.

SUMMARY OF THE INVENTION

Therefore, it is an object of the invention to provide a method and apparatus for leveling a die on a die-forming machine, such as a stretch-wrapping machine.

It is another object of the invention to provide a method and apparatus for permitting simultaneous adjustment of the vertical and horizontal position of a die.

It is another object of the invention to provide a method and apparatus for permitting precisely the same vertical and horizontal position be repetitively and automatically obtained.

These and other objects of the present invention are achieved in the preferred embodiments disclosed below by providing in an apparatus for forming members about a die mounted on die posts on a die base, the improvement comprising leveling means for leveling the die. The leveling means comprises a die base on which first and second die posts are mounted for adjustable vertical movement. A first motor means is operatively connected to the first die post for moving the first die post in a vertical direction. First vertical position sensing means cooperate with the first motor means for sensing the vertical position of the first die post. First servo-feedback means interconnect the first motor means and the first vertical position sensing means for transmitting a vertical position signal from the first vertical position sensing means to the first servo-feedback means. A second motor means is operatively connected to the second die post for moving the second die post in a vertical direction. Second vertical position sensing means cooperate with the second motor means for sensing the vertical position of the second die post. Second servo-feedback means interconnect the second motor means and the second vertical position sensing means for transmitting a vertical position signal from the second vertical position sensing means to the second servo-feedback means. Indexing means may be provided for interconnecting the first and second vertical position sensing means and the first and second servo-feedback means for operating the first .and second motor means in unison speed and direction to position the die in a level position at a predetermined vertical position.

According to one preferred embodiment of the invention, the first and second vertical position sensing means comprise first and second displacement transducers.

According to another preferred embodiment of the invention, the first and second motor means each include a tachometer and encoder for controlling the rotational position of the motor means.

According to yet another preferred embodiment of the invention, the first and second servo-feedback means comprise first and second servo-amplifiers.

According to yet another preferred embodiment of the invention, the first and second die posts each comprise a stationary-mounted die post core having a drive shaft bore therein. A drive shaft is rotationally-mounted in the drive shaft bore of the die post for rotation by the associated motor means. A die post shell defines a bore therein with the die post core positioned in the bore of the die post shell for vertical movement relative to the die post core. The die post shell includes means for supporting the die. Actuating means cooperates with the drive shaft and the die post shell to convert rotational movement of the drive shaft into vertical movement of the die post shell and the die supported thereon.

According to yet another preferred embodiment of the invention, the actuating means comprises a threaded actuating nut carried on the drive shaft for rotation therewith. Mating threads are formed on the inner wall of the die post shell defining the bore thereof and are positioned in rating relation to the threads of the actuating nut for causing vertical movement of the die post shell.

According to another preferred embodiment of the invention, the first and second motor means each comprise a servo-motor and an associated tachometer and position encoder, a drive gear driven by the servo-motor and a driven gear mounted on the drive shaft for rotation therewith. The driven gear has an axis of rotation parallel to and laterally spaced from the drive gear. Endless belt means connect together the drive gear and the driven gear for unison rotation.

According to yet another preferred embodiment of the invention, the axis of rotation of the servo-motor is perpendicular to the axis of rotation of the drive and driven gears, and the motor means includes a right-angle gear box for transmitting rotation from the motor to the drive gear.

According to yet another preferred embodiment of the invention, anti-rotation means are provided for preventing rotation of the die post shell when being raised or lowered by the rotation of the drive shaft.

According to yet another preferred embodiment of the invention, the die post shell includes a support flange for supporting the die, with external screw threads formed on an exterior surface of the die post shell, and a retaining nut threadingly positioned on the die post shell for cooperating with the support flange for securing the die to the die post shell.

An embodiment of the method according to the invention comprises the steps of determining a desired vertical position of the die, determining the position of each of the first and second die posts, transmitting the position of each of the first and second die posts to a computer and outputting signals from the computer to first and second motors driving respective first and second die posts indicating the position of the first and second die posts and the direction of vertical movement required to move the die posts from the indicated position to the desired position. The vertical position of the die posts is adjusted accordingly.

The above method steps are repeated until the signals transmitted to the computer indicates that both of the first and second die posts are at a vertical position indicative of a level condition.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
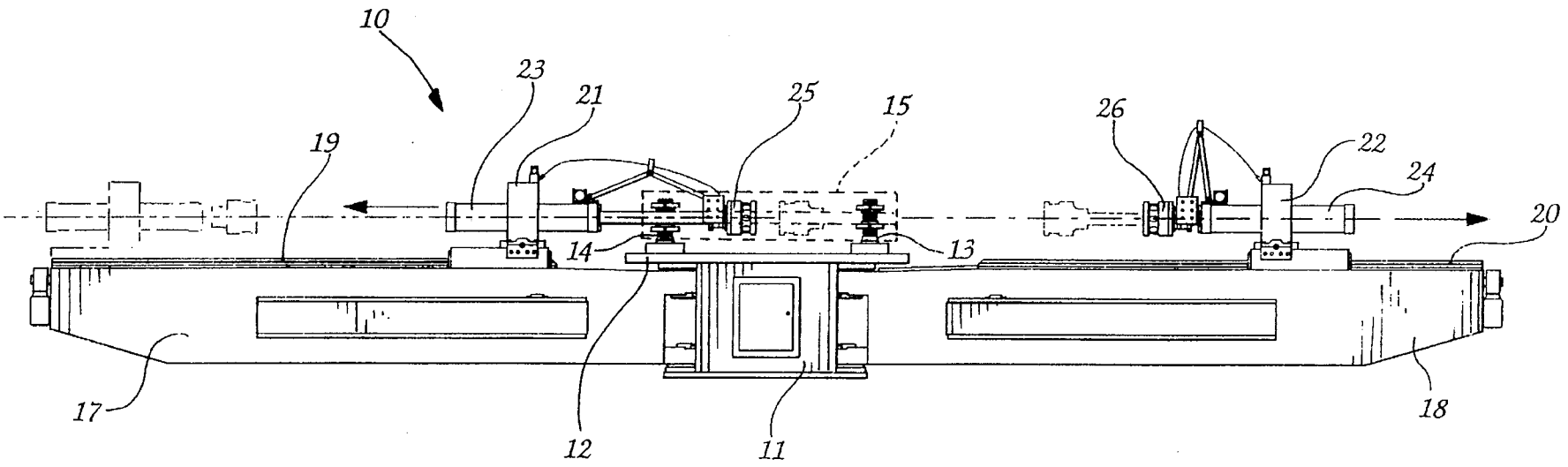
FIG. 1 is a front elevation of a die-forming machine according to an embodiment of the invention.
Figure 2:
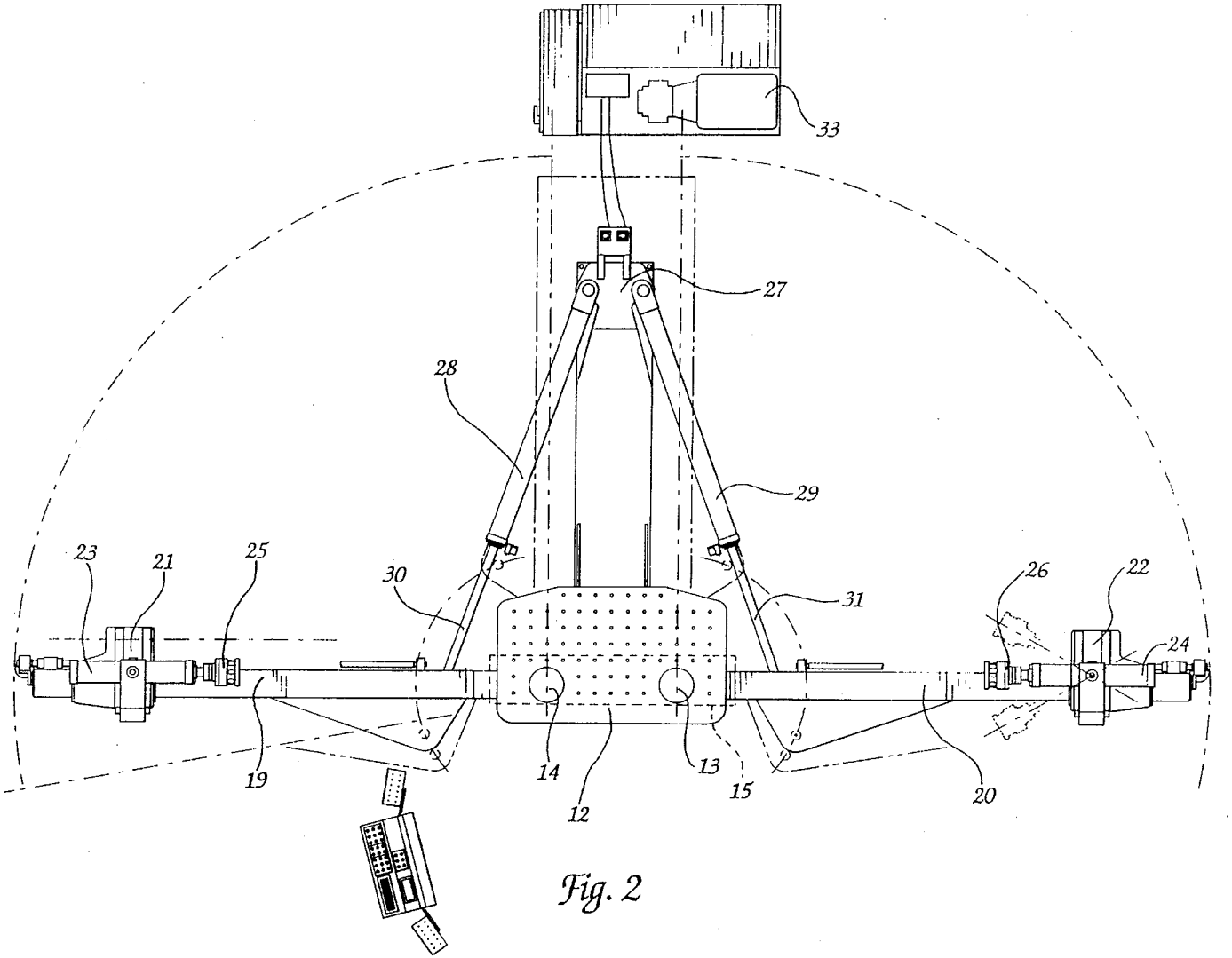
FIG. 2 is a top plan view of a die-forming machine substantially as shown in FIG. 1, with a control console.

Referring now specifically to the drawings, a die-forming machine according to an embodiment of the present invention is illustrated in FIGS. 1 and 2, and shown generally at reference numeral 10. The particular embodiment shown is a stretch-wrapping machine, which stretches a workpiece such as an extrusion or angle beam into its yield state and wraps the workpiece around a die to impart a predetermined shape to it. The invention is not limited to any particular type of forming machine, but is applicable to any machine which uses a die around which to form a workpiece.

Die-forming machine 10 includes a die base 11 which forms a platform for the die base support surface 12, die posts 13 and 14, and die 15 mounted on the die posts 13 and 14. Two wrap arms 17 and 18 are pivotally mounted on opposite sides of the die base 11, and are pivoted rearwardly as the stretch-wrapping process takes place. See FIG. 2. The wrap arms 17 and 18 have respective ways 19 and 20 on which are mounted moveable carriages 21 and 22. Respective hydraulic tension cylinders 23 and 24 are carried by carriages 21 and 22, and carry hydraulically-powered jaws 25 and 26 into which the workpiece to be stretch-wrapped is secured by its opposite ends. Jaws 25 and 26 are pivoted on the carriages 21 and 22 to permit pivotal movement as the stretch-wrapping process takes place.

As is best shown in FIG. 2, a tail section 27 of the die base 11 extends outwardly from the rear of the die base 11 and mounts a pair of wrap cylinders 28 and 29. Hydraulic wrap cylinder piston rods 30 and 31 are connected to the wrap arms 17 and 18, as shown in FIG. 2, and, when actuated, pivot the wrap arms 17 and 18 rearwardly, wrapping the workpiece being formed around the die 15. A hydraulic motor and pump assembly 33 supplies pressurized hydraulic fluid to the hydraulic components of the machine 10.

Die-forming machines of the type described in this application generally have at least two die posts, such as die posts 13 and 14. The die posts 13 and 14 secure the die 15 onto the support surface 12 of the die base 11, prevent rotational movement of the die and provide lateral stability during the wrapping process. The die 15 includes a profile which matches the profile of the workpiece to be stretch-wrapped. The profiles mate and provide stability to the workpiece as the stretch-wrapping process continues. Ordinarily the jaws 25 and 26 will be positioned so that the workpiece is held perpendicularly to the vertical axis, i.e. in a "level" horizontal position.

In order for the stretch-wrapping process to be carried out correctly, the horizontal orientation of the die 15 must exactly match the horizontal orientation of the workpiece. As noted above, in prior art devices, a level is placed on top of the die and the jack screws are adjusted until the level indicates that the die is positioned correctly.

Figure 3:
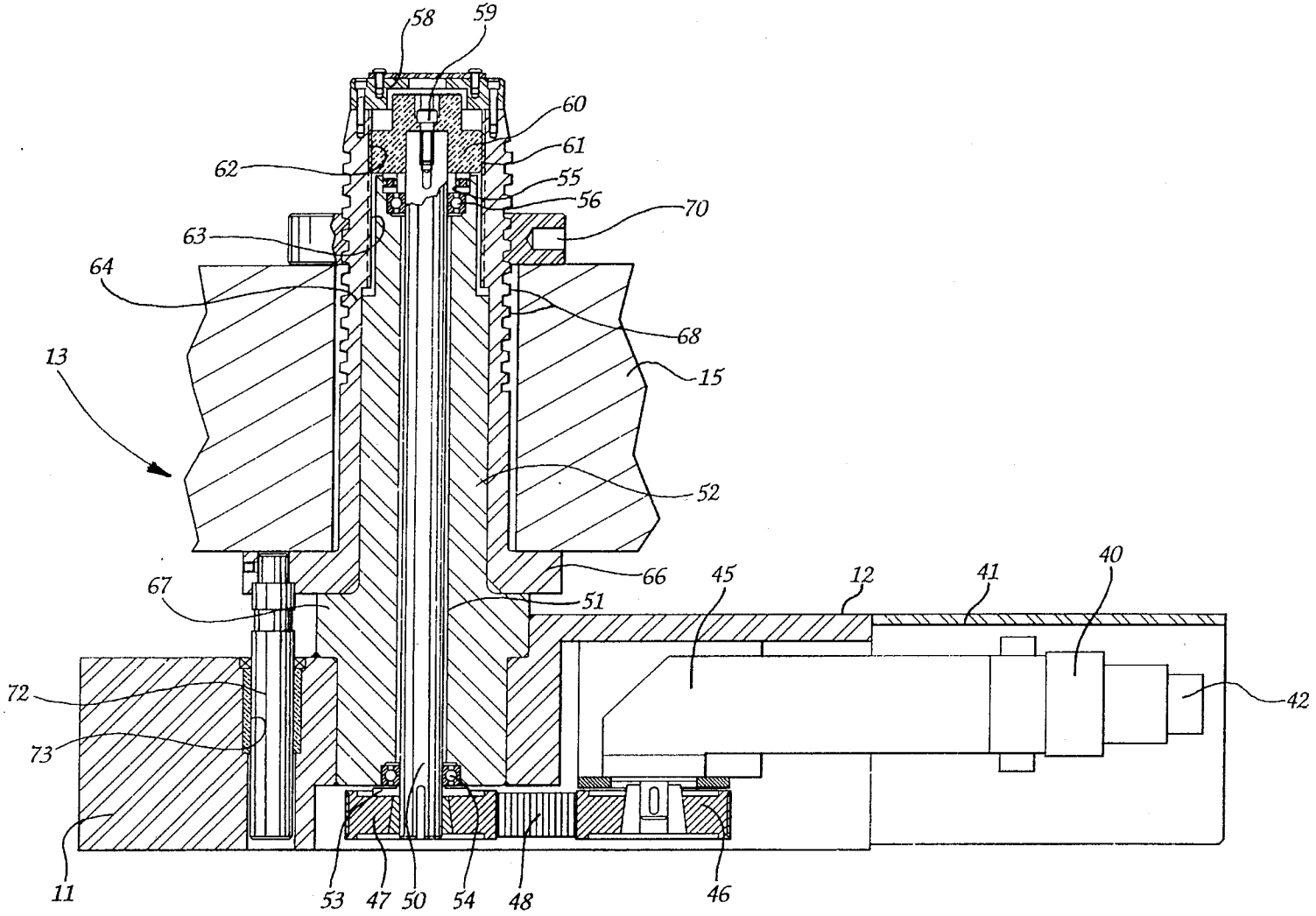
FIG. 3 is a is a vertical cross-sectional view of one of the two die posts of the die-forming machine illustrated in FIGS. 1 and 2, at a lowermost die position.

Referring now to FIG. 3, die post 13 and the associated leveling components are shown in cross-section. Die post 14 contains the same components and operates in an identical fashion. For this reason, description of the die post 13 will be understood to relate equally to the die post 14.

Die post 13 is mounted in the die base 11 below the support surface 12. A motor, such as a permanent magnet DC motor 40, is mounted in a motor housing 41 beneath support surface 12. Motor 40 includes a tachometer 42. The tachometer provides a motor shaft speed feedback signal which improves the stability of the position servo-system according to the invention.

Motor 40 is connected to a right angle precision gear box 45 which drives a drive gear 46. Drive gear 46 drives a driven gear 47 through a timing belt 48. Driven gear 47 is splined to the bottom end of a drive shaft 50. Drive shaft 50 is mounted for rotation within a drive shaft bore 51 of a die post core 52. Die post core 52 is welded to the die base 11. The drive shaft 50 is supported in the drive shaft bore 51 by a lower thrust bearing 53, an adjacent ball bearing assembly 54, an upper thrust bearing 55 and an adjacent ball bearing assembly 56. A post retainer 58 locks the drive shaft 50 into the drive shaft bore 51, and an axle pin 59 concentrically mounts the top end of the drive shaft 50 for coaxial rotation.

A threaded actuating nut 60 is mounted on top of the drive shaft 50 for rotation therewith. Threads 61 of the actuating nut 60 mate with threads 62 formed on the inner wall 63 of a die post shell 64. Die post shell 64 fits over the die post core 52. The rotational movement of the drive shaft 50 is converted to vertical up-and-down movement of the die post shell by the action of the threads 61 and mated threads 62.

An outwardly-extending flange 66 on the bottom of the die post shell 64 is seated against an enlarged shoulder 67 formed in the die post core 52 and defines the lowermost extent of travel of the die post shell 64.

Threads 68 on the outer surface of the die post shell 64 receive a threaded retaining nut 70. Die 15 is retained on the die post 13 by being supported on its lower end by the shoulder 66 on the die post shell 64 and on its top end by the retaining nut 70, which is threaded onto the threads 68 and tightly onto the top surface of the die 15. The die 15 is secured to the die post 14 in the same manner.

Figure 4:
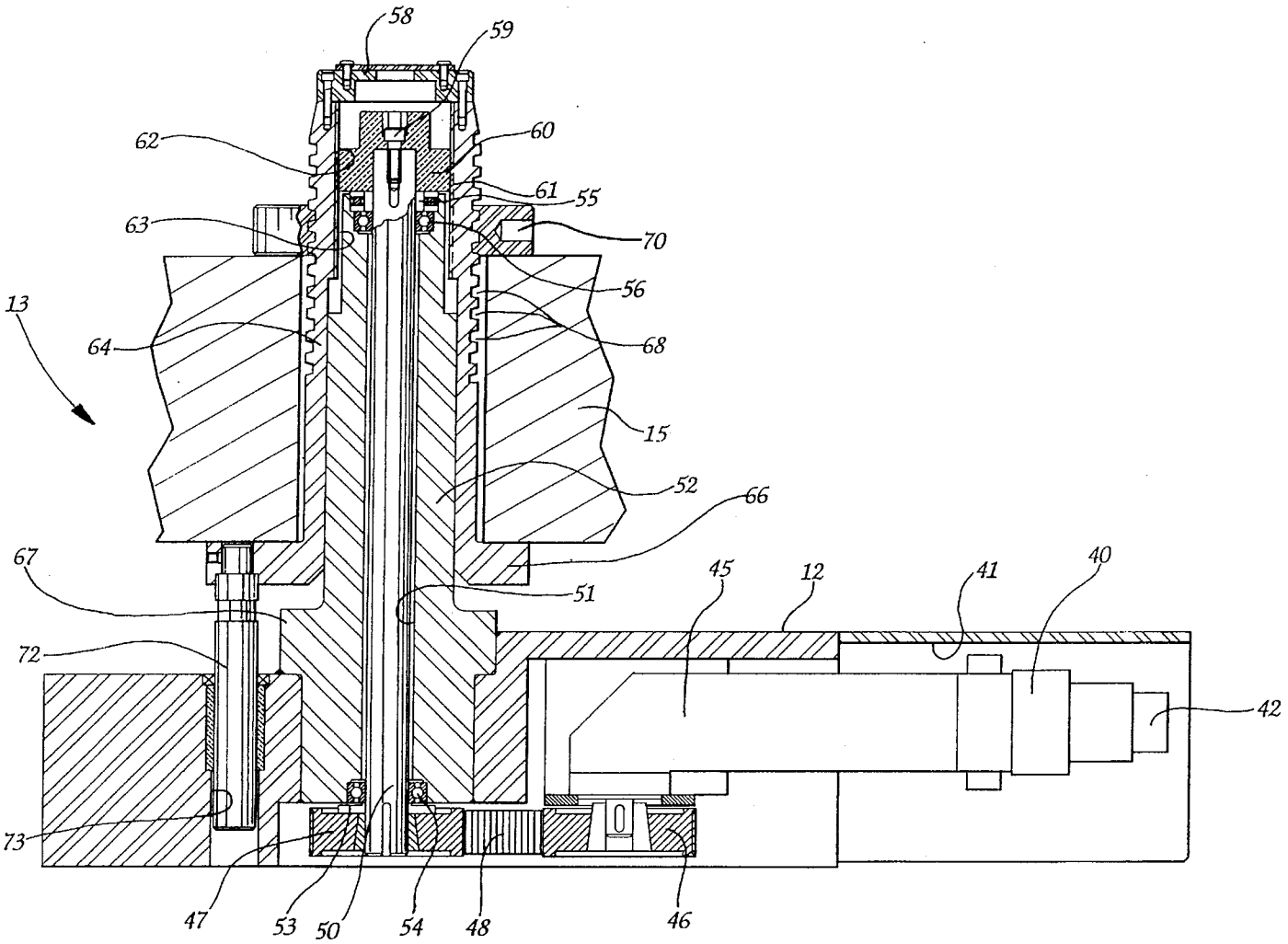
FIGS. 4 and 5 are cross-sectional views as in FIG. 3, showing the die at intermediate and upper positions.
Figure 5:
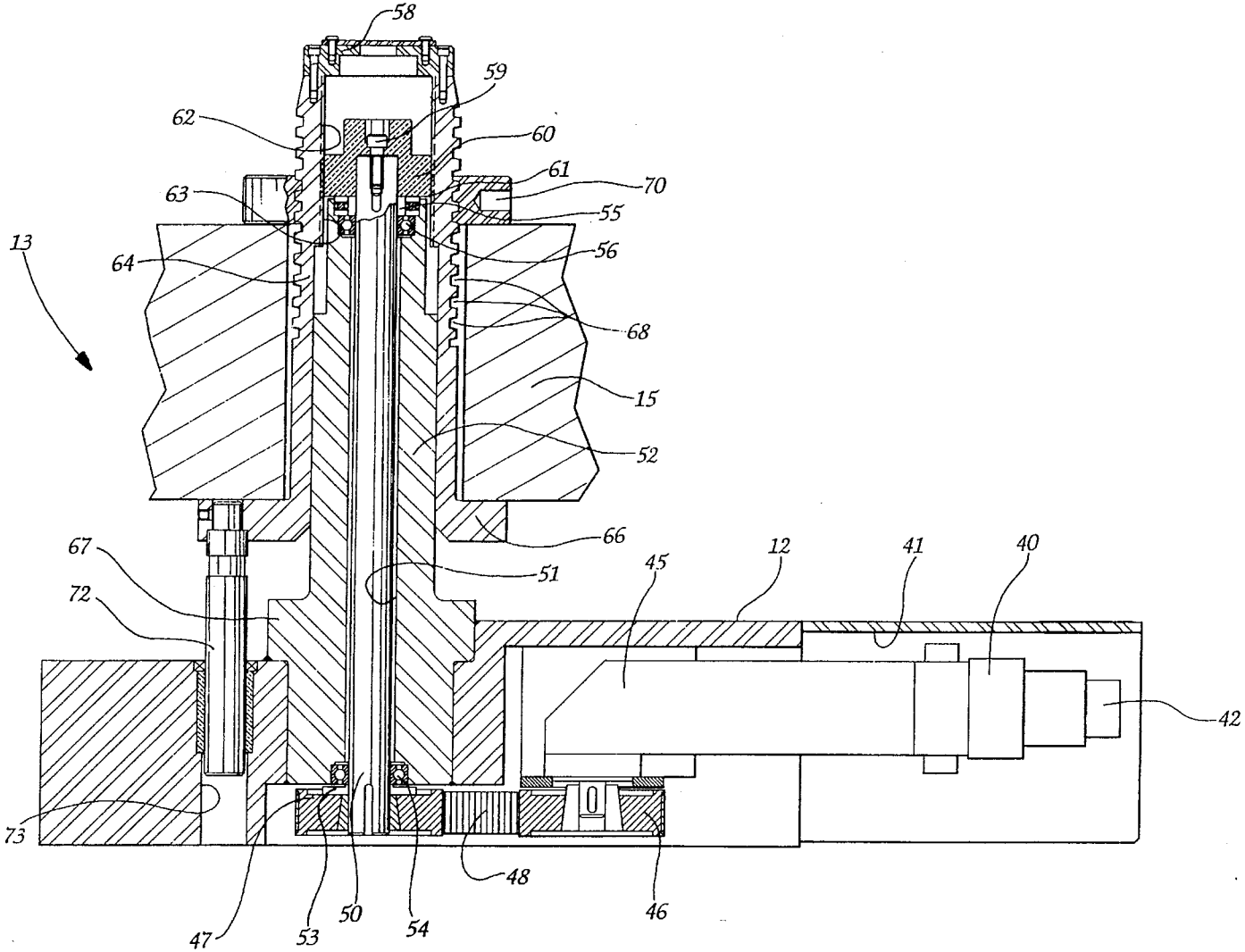

As is apparent from the foregoing description, the die post shell 64 must be free to move .upwardly and downwardly on the die post core 52. In order to prevent binding and wear, the die post core 52 and die post shell 64 are not keyed together to prevent relative rotation between them. An anti-rotation pin 72 is positioned for vertical sliding movement in a socket 73 in die base 11. As is shown by comparing the position of the anti-rotation pin 72 in FIGS. 3, 4 and 5, anti-rotation pin 72 slides upwardly in the socket 73 as the die post shell 64 is raised, while preventing rotation of the die post shell 64.

Figure 6:
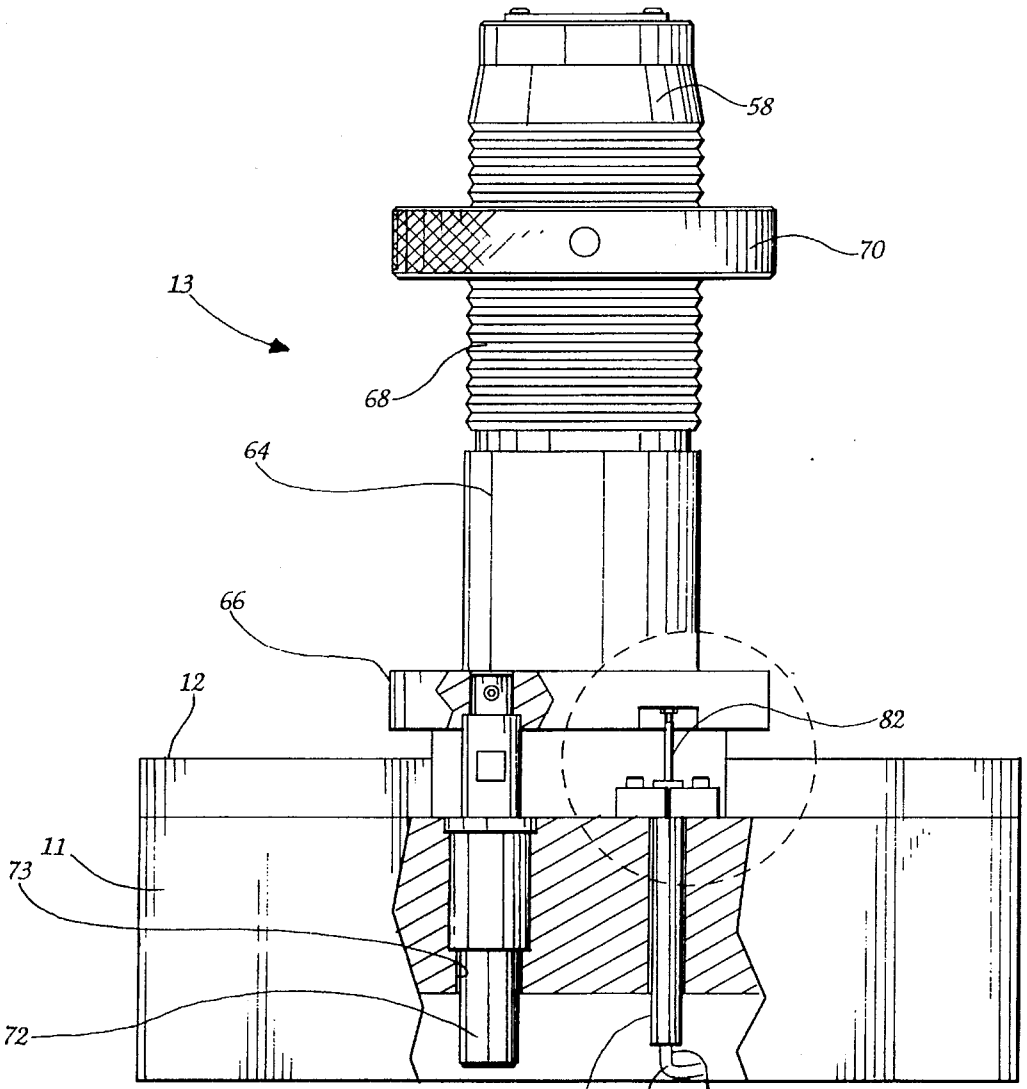
FIG. 6 is an elevation of a die post according to an embodiment of the invention, with parts broken away to show the anti-rotation pin and the displacement transducer.

Referring now to FIG. 6, die post 13 is shown from a different aspect. A displacement transducer 80, such as, for example, a Model LT or MLT linear position transducer manufactured by Data Instruments, Inc., is mounted in the die base 11. Transducer 80 includes a housing 81 in which a shaft 82 is slidably mounted. The free end of the shaft 82 is attached to the underside of the die post shell 64. A lead 84 transmits an output signal to a signal processor such as a computer 90. The output signal varies as a function of the position of the shaft 82 in the barrel 81, and thus to the vertical position of the die post shell 64 in relation to the stationary die base 11.

Figure 8:
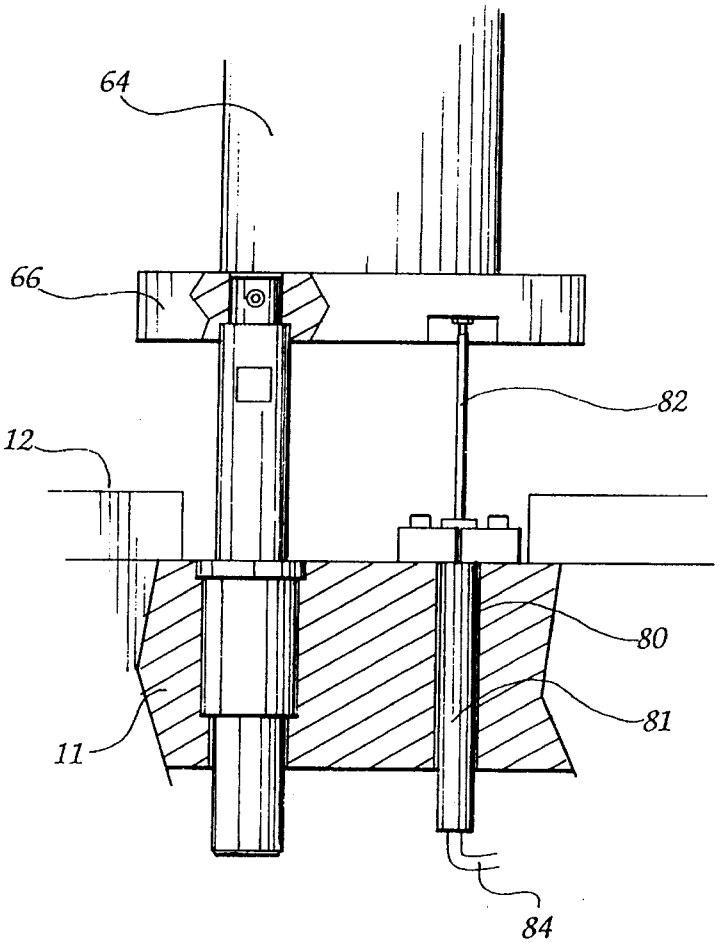
FIGS. 7 and 8 are elevations according to FIG. 6, with the die post shell at intermediate and upper positions.
Figure 7:
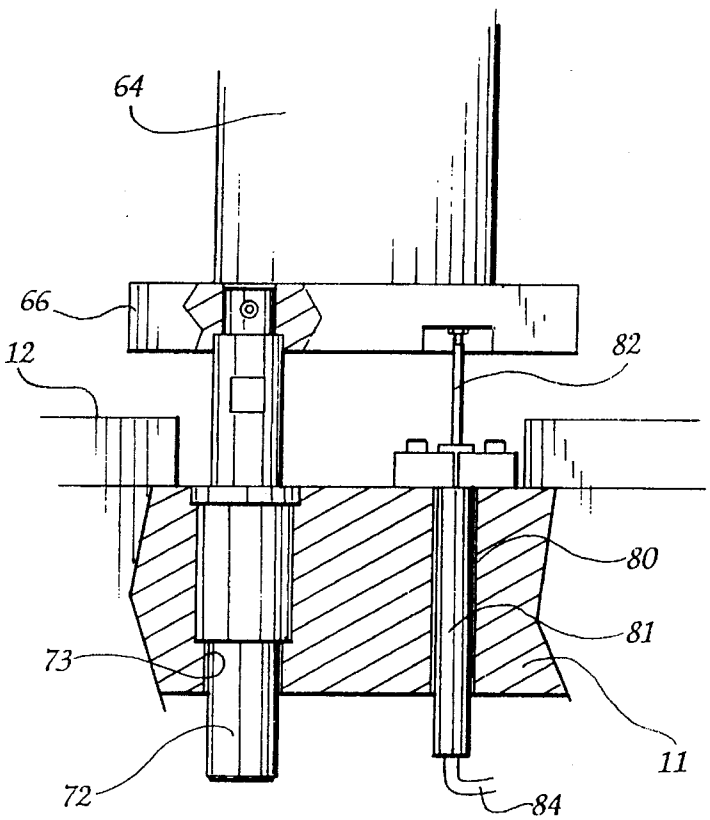

FIGS. 7 and 8 illustrate the movement of the shaft 82 as the die post shell 64 moves. Alternatively, the system can be operated manually through a manual controller 100.

Figure 9:
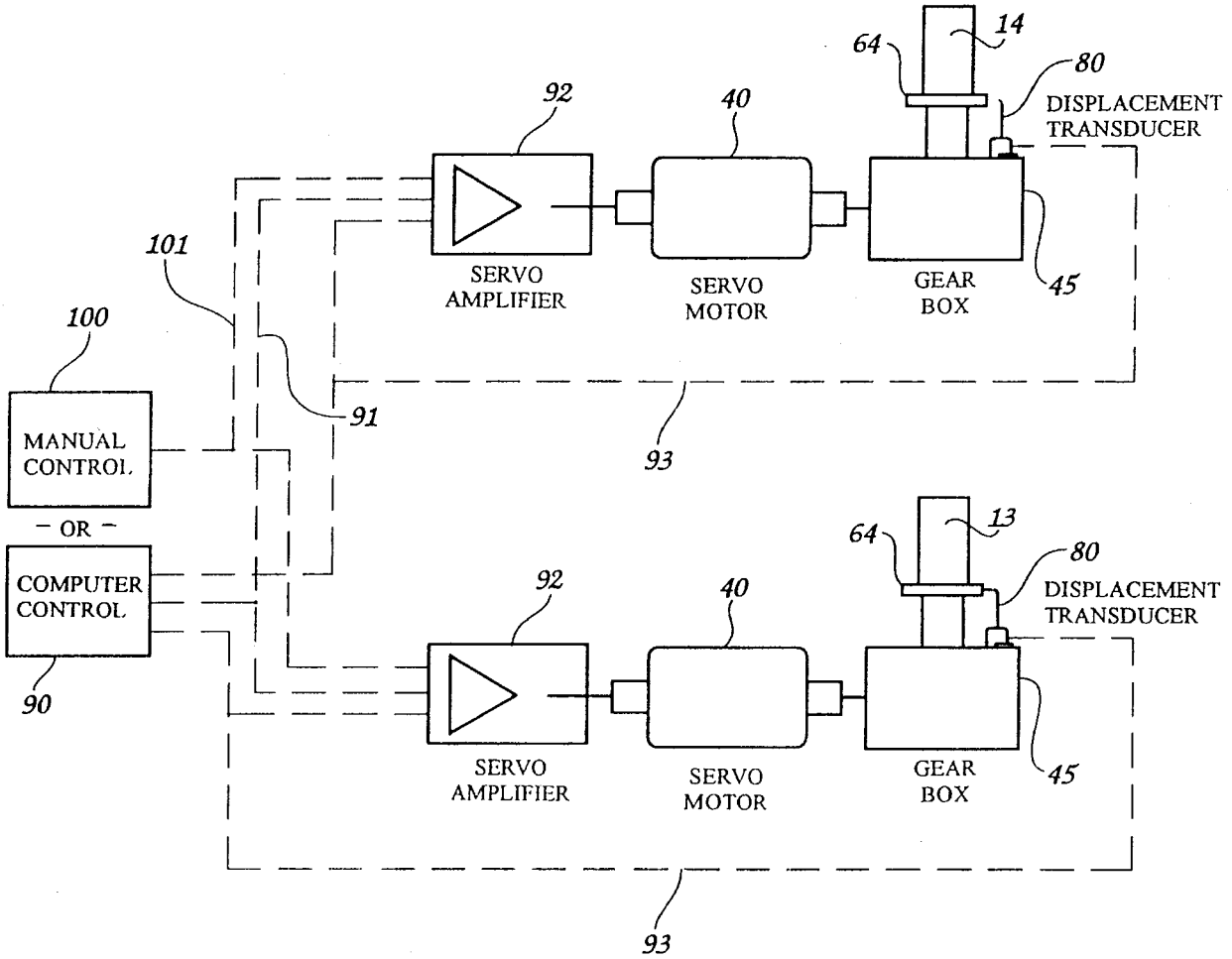
FIG. 9 is an electrical schematic of the leveling system.

Referring now to FIG. 9, operation of the leveling system is described. As noted above, both die posts 13 and 14 have identical components and operate in the same manner. Thus, the description above relating to die pest 13 is equally applicable to die post 14 and its associated components. Elements described with relation to die post 14 which are the same as those on die post 13 are shown with prime notation. In FIG. 9, the die posts 13 and 14 have been repositioned for clarity.

A die is placed on the die posts 13 and 14, as is shown in FIGS. 1 and 2. The retaining nut 70 on each of the die posts 13 and 14 is tightened down, immobilizing the die 15. A vertical position for the die is determined based on the vertical position of the jaws 25 and 26 and the shape and size of the member to be formed in relation to the position of the support surface 12 of the die base 11. Thus, an absolute value expressed as a vertical position of the die 15 is determined. The leveling system thus serves two functions—to position the die 15 at the predetermined vertical position, and to insure that the die is level, i.e., in an orientation which matches the orientation of the member so that they mate properly during the forming process.

The desired predetermined value representing the vertical position of the die 15 is entered into the computer 90 by the operator. This value is transmitted to both die posts 13 and 14 by wire 91. The signal is amplified by servo-amplifiers 92 and 92' and fed to servo-motors 40 and 40'. Motors 40 and 40' move the die post shells 64 and 64' towards the predetermined vertical position through the gear boxes 45 and 45'. The positions of the die post shells 64 and 64' are sensed by respective displacement transducers 80 and 80' which transmit resistance values corresponding to the position of respective die post shells 64 and 64' through wires 93 and 93' to both the computer 90 and through a feedback loop to respective servo-amplifiers 92 and 92'. The servo-amplifiers 92 and 92' transmit position information to respective servo-motors 40 and 40' which continue to move the die post shells 64 and 64' towards the correct vertical position.

When the die post shell 64 reaches the proper position, the signal from the transducer 80 exactly cancels the signal corresponding to that position, resulting in a "null" which in turn results in no signal being transmitted from the servo-amplifier 92 to the servo-motor 40. The servo-motor 40' ceases rotation instantly, and the die 15 is at the correct vertical position on the die post 13.

When the die post shell 64' reaches the proper position, the signal from the transducer 80' exactly cancels the signal corresponding to that position, resulting in a "null" which in turn results in no signal being transmitted from the servo-amplifier 92' to the servo-motor 40'. The servo-motor 40' ceases rotation instantly, and the die 15 is at the correct vertical position on the die post 14.

Alternatively, computer 90 can include indexing means which compares the vertical position of the die post shells 64 and 64', and controls the speed and direction of travel of the die post shells 64 and 64'. In another variation, the displacement transducers 80 and 80' can be designated as respective master and slave transducers, so that the position of the die post 14 is matched to the actual position of the die post 13, rather than to a value representing the position of the die posts 13 and 14.

The die posts 13 and 14 can be operated manually from the manual controller 100, which sends a position signal to either or both of the die posts 13 and 14. The desired level position or a position where the die posts 13 and 14 are intentionally not level can be manually achieved.

A method and apparatus for leveling a die on a die-forming machine is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In an apparatus for forming members about a die mounted on die posts on a die base, the improvement comprising leveling means for leveling the die, said leveling means comprising:

(a) a die base on which first and second die posts are mounted for adjustable vertical movement;

(b) a first motor means operatively connected to said first die post for moving said first die post in a vertical direction;

(c) first vertical position sensing means cooperating with said first motor means for sensing the vertical position of said first die post;

(d) first servo-feedback means interconnecting said first motor means and said first vertical position sensing means for transmitting a vertical position signal from said first vertical position sensing means to said first servo-feedback means;

(e) a second motor means operatively connected to said second die post for moving said second die post in a vertical direction;

(f) second vertical position sensing means cooperating with said second motor means for sensing the vertical position of said second die post;

(g) second servo-feedback means interconnecting said second motor means and said second vertical position sensing means for transmitting a vertical position signal from said second vertical position sensing means to said second servo-feedback means; and (h) said first and second motor means each including a tachometer and encoder positioned in rotational alignment with respective drive shafts of said first and second motor means for sensing and controlling rate of rotation and rotational position of the drive shafts of the respective first and second motor means and outputting said vertical position signals to the respective first and second servo-feedback means.

2. In an apparatus according to claim 1, and including indexing means interconnecting said first and second vertical position sensing means and said first and second servo-feedback means for operating said first and second motor means in unison speed and direction to position the die in a level position at a predetermined vertical position.

3. In an apparatus according to claim 1, wherein said first and second servo-feedback means comprise first and second servo-amplifiers.

4. In an apparatus according to claim 1, wherein said first and second die posts each comprise:

(a) a stationary-mounted die post core having a drive shaft bore therein;

(b) a drive shaft rotationally-mounted in the drive shaft bore of said die post core for rotation by said associated motor means;

(c) a die post shell defining a bore therein and concentrically positioned with said die post core positioned in the bore of said die post shell for vertical movement relative to said die post core, said die post shell including means for supporting the die; and (d) actuating means cooperating with said drive shaft and said die post shell to convert rotational movement of said drive shaft into vertical movement of said die post shell and the die supported thereon.

5. In an apparatus according to claim 4, wherein said actuating means comprises a threaded actuating nut carried on the drive shaft for rotation therewith, and mating threads on the inner wall of the die post shell defining the bore thereof positioned in mating relation to the threads of said actuating nut for causing vertical movement of said die post shell.

6. In an apparatus according to claim 4, and including means for preventing rotation of said die post shell when being raised or lowered by the rotation of said drive shaft.

7. In an apparatus according to claim 4, said die post shell including a support flange for supporting the die, external screw threads formed on an exterior surface of said die post shell, and a retaining nut threadingly positioned on said die post shell for cooperating with said support flange for securing the die to the die post shell.

8. A method of leveling a die mounted for vertical movement on first and second die posts on a die-forming machine, comprising the steps of:

(a) determining a desired vertical position of the die;

(b) determining the position of each of the first and second die posts;

(c) transmitting the position of each of the first and second die posts to a computer;

(d) outputting signals from said computer to first and second motors having respective drive shafts which drive respective first and second die posts, said signals indicating the position of said first and second die posts and the direction of vertical movement required to move the die posts from the indicated position to the desired position;

(e) adjusting the vertical position of the die posts by rotating the drive shafts of the first and second motors;

(f) repeating steps (b) through (e) until the signals transmitted to the computer indicates that both of the first and second die posts are at a vertical position indicative of a level condition.

* * * * *